United States Patent [19]

Scott

[11] 4,310,258

[45] Jan. 12, 1982

[54] INK RIBBON LUBRICATION BY LIQUID SILICONE OIL

[75] Inventor: Michael A. Scott, Huntington, N.Y.

[73] Assignee: Columbia Ribbon & Carbon Mfg. Co., Inc., Plainview, N.Y.

[21] Appl. No.: 121,427

[22] Filed: Feb. 14, 1980

[51] Int. Cl.[3] ..... B41J 5/18

[52] U.S. Cl. ..... 400/241.1; 400/247; 400/237

[58] Field of Search ..... 101/96, 100, 102, 107, 101/336; 400/241, 241.1, 241.2, 241.4, 247, 237; 428/306, 307

[56] References Cited

U.S. PATENT DOCUMENTS

| | | | |
|---|---|---|---|
| 3,037,879 | 6/1962 | Newman et al. | 400/241.1 X |
| 3,102,824 | 9/1963 | Newman | 400/241.1 X |
| 3,682,764 | 8/1972 | Findlay et al. | 400/241.1 X |
| 3,825,104 | 7/1974 | Wolowitz | 400/241.1 X |
| 3,924,532 | 12/1975 | Hubbard et al. | 101/92 X |
| 4,016,321 | 4/1977 | McIntyre | 400/241.4 X |
| 4,164,180 | 8/1979 | Ellefson et al. | 101/93.34 |

FOREIGN PATENT DOCUMENTS

| | | | |
|---|---|---|---|
| 998931 | 10/1976 | Canada | 400/241.1 |
| 130218 | 10/1979 | Japan | 400/241.1 |

*Primary Examiner*—Edward M. Coven
*Attorney, Agent, or Firm*—Thomas L. Tully

[57] ABSTRACT

High speed printing machine incorporating a pressure-sensitive transfer ribbon of the squeeze-out or reusable type having a thin, flexible plastic film foundation having bonded thereto a microporous resinous ink layer containing pressure-exudable liquid ink which is adapted to be pressure-transferred to a copy sheet by means of a printing element which makes momentary impression contact with the ribbon while the ribbon is moving slowly across the path of said printing element. The invention comprises a high speed printing or impact machine which includes means for the application of a thin friction-reducing or slip-permitting film of liquid silicone oil to the rear or impact surface of the transfer ribbon in order to reduce the friction between the printing element and the moving transfer ribbon and to prevent grabbing of the film foundation and breakdown of the bond between the film foundation and the ink layer.

7 Claims, 2 Drawing Figures

INK RIBBON LUBRICATION BY LIQUID SILICONE OIL

BACKGROUND OF THE INVENTION

Transfer elements having microporous ink layers containing pressure-exudable flowable ink are well-known, and reference is made to U.S. Pat. Nos. 3,037,879 and 3,689,301 as representative thereof.

Such transfer elements were originally developed for typewriter use in place of conventional wax-base carbon papers since the microporous ink layer did not transfer under a single impact pressure, as is the case with one-time wax carbon layers, but rather functioned by exuding pressure-flowable ink from the microporous sponge binder material each time the transfer element was subjected to typing pressure, even over the same area.

More recently, it has been found desirable to use such transfer elements in ribbon form in high speed typing or impact printing machines and bar code printers which operate at such speeds that conventional one-time transfer elements are impractical since they are used up so quickly that they must be replaced at frequent intervals. The microporous transfer ribbons may be reversed and reused several times, depending upon the printing machine, or more commonly, are transported in a continuous creeping motion through the machine so that each area of the ribbon is subjected to several overlapping impacts before it passes the impact station as the machine transfers characters at a rate of up to twenty per second—see U.S. Pat. Nos. 3,954,163, 4,037,706 and 4,164,180, for example.

An important problem has been encountered during the use of such microporous transfer ribbons in high speed printing machines and bar code printers in which the ribbon is in constant slow motion during impact, i.e., it is hit by the type element or print face without any stoppage of movement of the ribbon—see U.S. Pat. No. 3,924,532. The copy sheet may also be in movement in the same direction or in a direction perpendicular to the direction of movement of the ribbon. In any event, the ribbon is moving slowly through the impact station when it is engaged by the typing face and, even though the period of engagement may be momentary, the typing face embosses and can snag the rear face of the ribbon and cause a breakdown of the bond between the film foundation and the ink layer supported thereby. This breakdown results in a transfer of solid particles of the microporous resin structure of the ink layer to the copy sheet, rather than the desired exudation of the ink from the microporous resin structure, and the production of spotty and dirty images on the copy sheet.

Also, particularly in the case of narrow ribbons, the frictional engagement or snagging of the moving ribbon by the type face can result in a breakage of the ribbon.

It was felt that such problems were inevitable with the use of microporous transfer ribbons in high-speed impact and printing machines, due to the spongy nature of the ink-exuding microporous resinous layer and the high pressures exerted by the type element, print hammer or bar code fonts.

SUMMARY OF THE INVENTION

The present invention is based upon the discovery that although smooth plastic film foundations, particularly embossment-resistant films such as tensilized polyethylene terephthalate, have an exceptionally smooth, rear surface, the performance of film-base transfer elements of the microporous, ink-releasing type in high speed printing machines can be improved substantially by applying to the rear impact surface of such transfer elements an exceptionally thin, slip-permitting, substantially continuous film of a friction-reducing composition comprising a liquid silicone oil.

I have discovered that although microporous, ink-releasing layers must be compressible in order to exude the flowable ink therefrom, such compression will not result in a grabbing or snagging of the transfer ribbon during high speed operation if the rear impact surface of the polyester film foundation is coated with a thin continuous film of a silicone oil to form a thin, continuous, slip-permitting liquid film which reduces the effects of friction between the impact elements, such as type faces, and the impacted surface of the transfer ribbon, thereby permitting the impact element to engage and disengage the back of the ribbon smoothly even though the ribbon is in motion during impact. Thus the impact element is able to engage the rear surface of the moving transfer ribbon, slip into transfer contact position and slip back out of engagement without loss of relative motion therebetween, i.e., the impact element does not snag or grab the polyester film foundation or cause such distortion or embossing thereof as can result in a rupture or breakdown of the bond between the film foundation and the microporous ink layer. Thus the ink layer functions in its intended manner by exuding liquid ink to the copy sheet to form images which are uniform and sharp, and which are clean to the touch since they are absorbed into the copy sheet surface and are free of any solid particles of the microporous resinous structure.

The slip-permitting silicone oils, useful according to the present invention, have the following essential characteristics. They have a sufficiently low viscosity in that they are capable of being applied as a thin, continuous coating which does not substantially increase the thickness of the film foundation and, therefore, does not reduce the sharpness or quality of the images typed. Also, the slip-permitting silicone oil coating must be inert with respect to the microporous ink layer, particularly the pressure-exudable ink present therein, so that the backing coating does not absorb or contaminate the ink layer when the transfer ribbon is collected on a spool or roller.

The preferred silicone oils for use in the present invention are the liquid polysiloxanes having a viscosity within the range of from about 1,000 centipoises to about 300,000, particularly the dimethyl polysiloxane oils and the methyl, phenyl polysiloxane oils such as those commercially-available from Dow Corning Company under the registered trademark 200 Fluid and Methyl Silicone Oil available from Goldschmidt AG, Essen, Germany (viscosity of 10,000 cps at 25° C.).

The present silicone back coatings can be applied by any suitable means such as gravure printing techniques, using a number 100 or 110 gravure printing cylinder, or by means of a felt applicator, a porous roller, or the like.

For purposes of simplification, reference is made to U.S. Pat. Nos. 3,689,301, 3,037,879, 4,164,180 and 3,924,532, the disclosures of which are incorporated herein by reference. The first two patents disclose suitable film-base microporous, reusable transfer elements which may be used according to the present invention, while the latter two patents disclose high speed printing machines in which the pressure-transfer ribbon is moving at the instant of the pressure-transfer operation.

Figure 1:
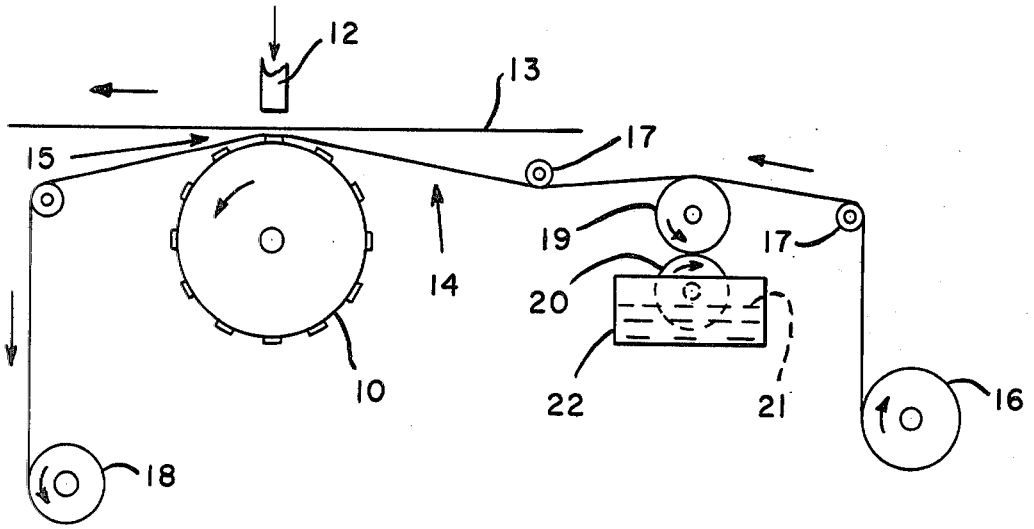
FIG. 1 is a plan view of a high speed printing machine incorporating means for transporting a pressure-sensitive transfer ribbon past an impact station and means for applying a continuous film of liquid silicone oil to the rear face of the ribbon at a location immediately in advance of the entry of the ribbon into the impact station.

Referring to the drawing, FIG. 1 illustrates a high speed printing machine of the type disclosed in detail in U.S. Pat. No. 4,164,180, the present illustration being limited to the modification of said machine according to the present invention. Thus FIG. 1 shows a rotatable print wheel 10 carrying raised image faces 11 on the surface thereof and a hammer bank 12 spaced from the surface of the print wheel 10 and mounted for instantaneous movement towards the surface of the print wheel to compress a copy sheet 13 against a transfer ribbon 14 in the print station 15. The print wheel 10 is indexed electronically and rapidly to present the proper image face 11 at the print station as the copy sheet 13 and transfer ribbon 14 are moving through the print station at different speeds, and the hammer 12 is activated electronically at the correct instant to compress the copy sheet against the inked surface of the ribbon and cause ink to transfer to the copy sheet in areas corresponding to the face of the particular image 11 present in the print station 15.

FIG. 1 illustrates means for transporting the transfer ribbon 14 through the print station and for treating the rear surface of the ribbon in advance of the movement of the ribbon into the print station 15. Thus, the ribbon 14 is expended from a supply roll 16, moved over a series of idler rollers 17 to and from the print station 15 and collected on take-up roll 18 after use. In advance of the movement of the ribbon 14 into the print station 15, the ribbon is drawn across the surface of a coating roll 19, such as one having a gravured surface and carrying a uniform amount of a silicone oil which is continuously supplied thereto by means of an application roller 20 immersed within a supply 21 of the silicone oil contained within an oil reservoir 22.

The rear surface of the ribbon 14, i.e., the surface of the plastic film foundation 23 (shown in FIG. 2) which is engaged by the image face 11 during the printing operation, is drawn under slight tension over the surface of the coating roll 19 which moves at the same surface speed as the ribbon 14 to effect transfer of a substantially uniform film 24 (shown by FIG. 2) of liquid silicone oil to the rear surface of the ribbon. The front surface of the ribbon 14, i.e., the ink layer 25 (shown in FIG. 2), is not contacted during application of the silicone oil treatment and the rear surface of the ribbon 14 carrying the silicone oil film is not contacted by any surface until it makes engagement with image faces 11 of the print wheel 10.

Figure 2:
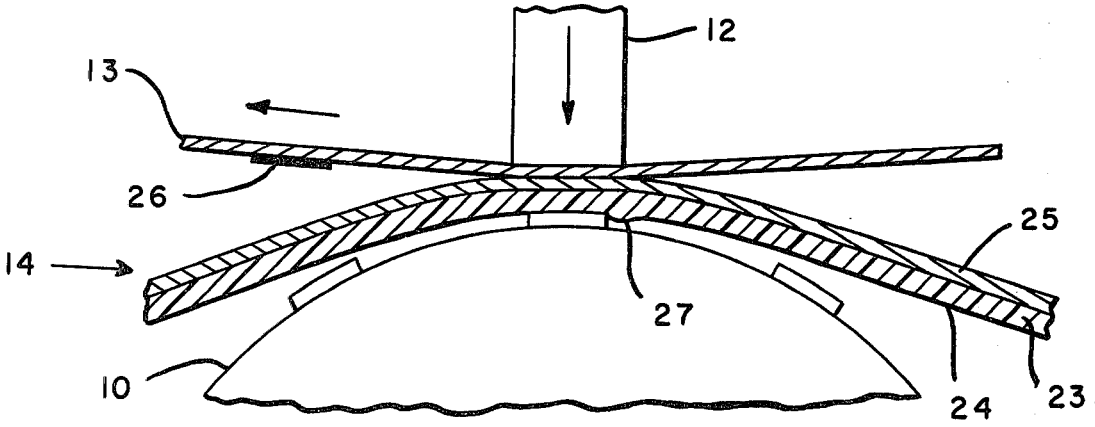
FIG. 2 is an enlarged view illustrating the configuration of the present treated ribbon at the instant of pressure impact in the present printing machine.

Referring to FIG. 2 which illustrates the deformation of the copy sheet 13 and transfer sheet 14 at the moment of impact in the print station 15, the hammer 12 is caused to crash against the back surface of the copy sheet 13 and press the front surface of the copy sheet against the surface of the ink layer 25 and press the silicone oil surface 24 of the transfer ribbon 14 against the image face 11 present in the print station 15. The pressure exerted is momentary but is sufficient to compress and deform the sheets slightly as ink is transferred to the surface of the copy sheet to form printed images 26.

As illustrated by FIG. 2, the copy sheet 13 and transfer sheet 14 are under pulling tension at the moment of impact since they are mounted for continuous motion through the print station 15. This does not cause any problem with the copy paper 13, since the contacting surface of the hammer 12 is smooth and the copy paper is not very compressible. However, it does cause a problem with the transfer ribbon 14 since the contacting surface of the image face 11 is relatively sharp and the plastic film foundation 23 and ink layer 25 are compressible and deformable to conform to the outline of the image face 11. Thus, the transfer ribbon 14 tends to bulge in thickness immediately behind the point of engagement between the image face 11 and the ribbon 14, as illustrated at 27 in FIG. 2.

When the hammer 12 is retracted to release the compression between the copy sheet 13 and the transfer ribbon 14, both sheets are free to resume forward movement. Unless the ribbon 14 is able to slip out of engagement with the image face 11, which was under embossment engagement therewith during the impact operation, the ribbon will remain snagged on the image face and may tear and break. The distortion of the ribbon during even a momentary snagging can cause a breakdown in the bond between the ink layer 25 and the film foundation 23 which, in the case of reusable, squeeze-out type ink layers, can cause transfer of solid portions of the resin sponge, formation of dirty images and loss of reusability, i.e., inability to form successive images of good quality when previously struck portions of the ink layer are overstruck as the ribbon is moved at a creeping pace through the print station.

However, all of these problems are overcome by the application of the liquid silicone oil film 24 to the rear surface of the transfer ribbon, which liquid film renders the transfer ribbon exceptionally slippery and enables the transfer ribbon to slip into and out of engagement with the image faces without snagging. This result is surprising in view of the fact that other inert lubricating oils do not produce the same result.

The present silicone oil films are applied as the thinnest possible continuous liquid film 24 to the rear surface of the ribbon 14 having a thin film foundation 23, such as tensilized polyethylene terephthalate polyester (Mylar T), having a thickness of about 0.3 mil (0.0003 inch) to form the slip-permitting back coating having a weight of up to about one-half pound per ream.

The transfer ribbon 14 preferably is formed by first coating the film foundation with a thin layer of an undercoating composition, such as one based upon a vinyl resin, a linear polyester or a polyurethane, and then with a thin layer of a microporous resinous ink layer composition, such as disclosed in U.S. Pat. Nos. 3,689,301 or 3,037,879. For example, the film foundation 23 may be coated with a thin layer comprising 1 part by weight of a linear polyester resin, such as Vitel resin 5545, about 0.1 part by weight of a vinyl resin, such as Vinylite VYHH resin copolymer, a solvent such as methyl ethyl ketone and filler, if desired. The layer is dried by evaporation of the solvent to leave a continuous thin bonding layer having a thickness between about 0.00005 inch and 0.0001 inch on the Mylar T surface.

Thereafter, an ink composition comprising the following ingredients is mixed in a ball mill and ground together until highly dispersed to form a uniform coating composition:

| Ingredients | Parts by Weight |
|---|---|
| Vinyl chloride-vinyl acetate copolymer (Vinylite VYHH) | 12.0 |
| Mineral oil | 7.0 |
| Lanolin | 7.0 |
| Alkoline blue pigment toner | 1.0 |
| Untreated carbon black pigment | 6.0 |
| Inert filler | 2.0 |
| Sulfonated vegetable oil (wetting agent) | 1.5 |
| Naphtholite vehicle | 2.5 |
| Methyl ethyl ketone solvent | 61.0 |
| | 100.0 |

The ink coating composition is applied over the bonding layer on the film foundation as a uniform thin layer in an in-line coating operation during a single pass of the film through the coating machine. This is preferred, since the linear polyester bonding layer is somewhat sticky unless filler is included to reduce tack. The methyl ethyl ketone is evaporated first and then the Naphtholite is evaporated to form the ink layer having a thickness of from about 0.0005 inch up to about 0.0008 inch, preferably about 0.0006 inch. The ink layer 25 comprises a microporous, pressure-non-transferable network of the vinyl copolymer containing within the pores thereof a pressure-exudable ink having a high viscosity comprising the mineral oil, lanolin, wetting agent and pigments.

The coated, dried film is then cut into ribbons of the desired length and width for use in the high speed electronic typewriters and printing machines discussed hereinbefore which have been modified to provide the silicone oil application means of the present invention, conventional ribbon widths being ¼ inch, 5/16 inch, 1 inch and 1⅛ inch, depending upon the requirements of the machine.

While the use of tensilized polyester film is a preferred foundation for the present transfer elements, non-tensilized polyethylene terephthalate polyester film may also be used as well as other films such as polyethylene, polypropylene, nylon, and the like, having a thickness of from about 0.00015 inch (0.15 mil) up to about 0.001 inch (1 mil), most preferably between about 0.00025 inch and 0.0005 inch. The slip-permitting oil treatment reduces the embossment and stretching problems normally encountered with the use of such films.

Variations and modifications will be apparent to those skilled in the art in the light of the present disclosure and within the scope of the present claims.

I claim:

1. High speed printing apparatus adapted to feed a copy sheet and a pressure-sensitive transfer ribbon, comprising a flexible plastic film foundation supporting an ink-releasing layer on the front surface thereof, through a print station and to apply imaging pressure against the rear surface of said ribbon to cause imagewise transfer of ink from said layer to the surface of said copy sheet, said apparatus comprising a print station including an imaging element and a backing element spaced therefrom, means for forcing said elements together to impart an imaging pressure therebetween, means for feeding a said copy sheet through said print station so that the ink-releasing layer thereof is adjacent said copy sheet and the rear surface thereof is adjacent said imaging element, characterized by the presence of means for applying a thin, substantially continuous liquid film of silicone oil to the said rear surface of the pressure-sensitive transfer ribbon at a location in advance of the movement of said ribbon into said print station so that said ribbon carries said film of silicone oil at the time that the rear surface thereof is engaged by said imaging element.

2. An apparatus according to claim 1 in which said ribbon feeding means is adapted to impart substantially continuous feeding movement to said ribbon.

3. An apparatus according to claim 1 which includes means for moving said backing element against said imaging element to impart said imaging pressure.

4. An apparatus according to claim 1 in which said silicone oil-applying means comprises a coating roller, the surface of which is adapted to be provided with a continuous film of silicone oil and which is engaged by the rear surface of said transfer ribbon.

5. An apparatus according to claim 4 in which said coating roller has a gravured surface.

6. An apparatus according to claim 1 which further comprises means for supplying a length of said transfer ribbon to said oil-applying means and to said print station and means for collecting said transfer ribbon after it exits said print station.

7. In the method of forming a copy on a high speed printing machine in which a copy sheet and a pressure-sensitive transfer ribbon comprising a flexible polyethylene terephthalate polyester plastic film foundation supporting an ink-releasing layer on the front surface thereof are superposed and continuously fed through a printing station where a rapid succession of imaging pressures are applied against the rear surface of said transfer ribbon by means of an imaging element to effect the transfer of ink from said ink-releasing layer to said copy sheet to form a succession of images there, the improvement of which comprises coating the rear surface of said film foundation with a substantially-continuous thin film of liquid silicone oil to facilitate the disengagement of said imaging element from said transfer ribbon.

* * * * *